United States Patent [19]

Askonen

[11] Patent Number: 4,826,154

[45] Date of Patent: May 2, 1989

[54] EXERCISE DEVICE

[76] Inventor: Arto A. Askonen, Untamonkatu 50 C, SF-53100 Lappeenranta, Finland

[21] Appl. No.: 219,876

[22] Filed: Jul. 12, 1988

Related U.S. Application Data

[63] Continuation of Ser. No. 818, Jan. 6, 1987, abandoned.

[30] Foreign Application Priority Data

Jan. 7, 1986 [FI] Finland ..... 860054

[51] Int. Cl.[4] ..... A63B 21/06

[52] U.S. Cl. ..... 272/118

[58] Field of Search ..... 272/117, 118, 129, 130, 272/136, 142, 134

[56] References Cited

U.S. PATENT DOCUMENTS

| | | | |
|---|---|---|---|
| 3,572,700 | 3/1971 | Mastropaolo | 272/129 |
| 3,599,974 | 8/1971 | Price | 272/134 X |
| 4,600,189 | 7/1986 | Olschansky et al. | 272/118 |
| 4,616,825 | 10/1986 | Anderson | 272/117 X |
| 4,620,703 | 11/1986 | Greenhut | 272/129 |
| 4,666,149 | 5/1987 | Olschansky et al. | 272/134 |
| 4,709,919 | 12/1987 | Cano | 272/117 |

FOREIGN PATENT DOCUMENTS

| | | | |
|---|---|---|---|
| 2742106 | 3/1979 | Fed. Rep. of Germany | 272/117 |
| 7808453 | 6/1979 | Sweden | 272/118 |
| 687153 | 2/1953 | United Kingdom | 272/117 |

*Primary Examiner*—Richard J. Apley
*Assistant Examiner*—Robert W. Bahr
*Attorney, Agent, or Firm*—Michael N. Meller

[57] ABSTRACT

An exercise device in which a weight load can be lifted by pulling or pushing using an endless ring (1) and whereto a chain, wire, belt or the like (2) is connected at a suitable point, so that the weight load (3) can be moved by pushing or pulling a handle which moves a carriage (9) fastened at a desired point on the ring (1) by a locking device (12).

10 Claims, 2 Drawing Sheets

EXERCISE DEVICE

This application is a continuation of application Ser. No. 000,818, filed Jan. 6, 1987, now abandoned.

FIELD OF THE INVENTION

The invention relates to an exercise device in which the movement of different kinds of gripping, pulling and pushing handles can be resisted in both direction by means of a selected weight load. The starting point of the movement of the handle can be adjusted to the exercise to be made or the size of the exerciser.

BACKGROUND ART

The exerciser trains at a gymnasium by means of different kinds of adjustable weight loads. The adjustable weight loads are connected to various frames so that the exerciser can select a desired weight load by means of different kinds of lever arms, carriages and transmission means, and train with the weight load using different kinds of handles. The exerciser moves the weight load by means of the handles by constricting the muscle to be trained so that an increasing number of muscle cells in the muscle participate in the accomplishment of the movement. The greater the number of muscle cells made to participate in the accomplishment of the movement, the better the constricting capability of the muscle becomes.

The human body comprises plenty of muscles, and these can be divided into groups on the basis of their way of function. The function of the different muscle groups is to move a certain body part within its own range of motion. The human muscular system functions in two directions, comprising extensor muscles functioning in a direction away from the body and flexor muscles functioning in a direction towards the body. Due to these two different functions, exercise devices, too, are divided into two groups, because there is no exercise device on the market which resists movement in both directions.

In practice, gymnasina are equipped with a plurality of different kinds of devices. This is due to the way of function of the human muscular system and the size differences between individual exercisers, on account of which the push and pull handles have to be positioned at several points in order that everyone could exercise, and that the exercise would be meaningful. Therefore, there are plenty of nearly identical devices in the gymnasina, which devices, however, cannot be used crosswise.

For this reason, the gymnasina require expensive floor area and an enormous number of devices which are intended for training muscles in one direction only and which, in addition, can be used by exercisers of a certain size only. In general, there are several tens or even hundreds of devices. A major part of the devices are out of use for most of the time, because each device is intended for a strictly defined group of users.

Today, the biggest drawbacks of exercise devices are that they are inefficient and uneconomical; the devices cannot at all be used crosswise; and they are intended for a strictly defined group of users; further, temporary auxiliary structures are highly dangerous. These problems are mainly due to the fact that the exercise can be carried out in one direction only; since the pull handle is stationarily positioned, with little or no possibility for adjustment, it is possible by means of the device to carry out a single exercise in one direction only. If the devices are provided with temporary auxiliary structures uncompatible with the device, it may be possible that a few similar exercises can be made therewith, or a person of unsuitable proportions may be able to use the device.

In carriage systems, the initial weight load consists of the weight of the carriage and the different handles, so that the lowest weight load is usually far too high for beginners and particularly for women.

In lever systems, the weight load is unreal. It is necessary in the device to use oversized weight loads, which increases considerably the manufacturing costs of the weight load and the frame. In many cases, the lever arm requires even a double weight load.

A wire, chain, belt or some other transmission means enables the weight load to be pulled in the device in different directions from different heights, but it does not allow the weight load to be pushed.

The use of oversized weight loads used for one purpose only, heavy carriages, uneconomical lever systems and unreliable cords, wires and bulky, freely hanging chains is difficult and expensive, and requires a lot of room.

SUMMARY OF THE INVENTION

By means of the device according to the invention a decisive improvement is obtained with respect o the above drawbacks. For the achievement thereof, the device according to the invention is characterized by what is disclosed in claim 1.

The invention is advantageous mainly in that it enables movement in two directions, and that the movement can be resisted in both directions by means of a selected weight load. The free adjusting height of the handle does not restrict the movements or the users. The use of several such devices enables an efficient crosswise training, and increases the capacity. The weight loads are real, so that they need not be oversized, and the weight load is sufficiently light for beginners and women. The invention spares room, is neat in appearance, advantageous to manufacture, simple to adjust, and extremely safe for an unlimited group of users.

BRIEF DESCRIPTION OF THE DRAWING

In the following the invention will be described with reference to the attached drawing, wherein.

DESCRIPTION OF THE PREFERRED EMBODIMENT

Figure 1:
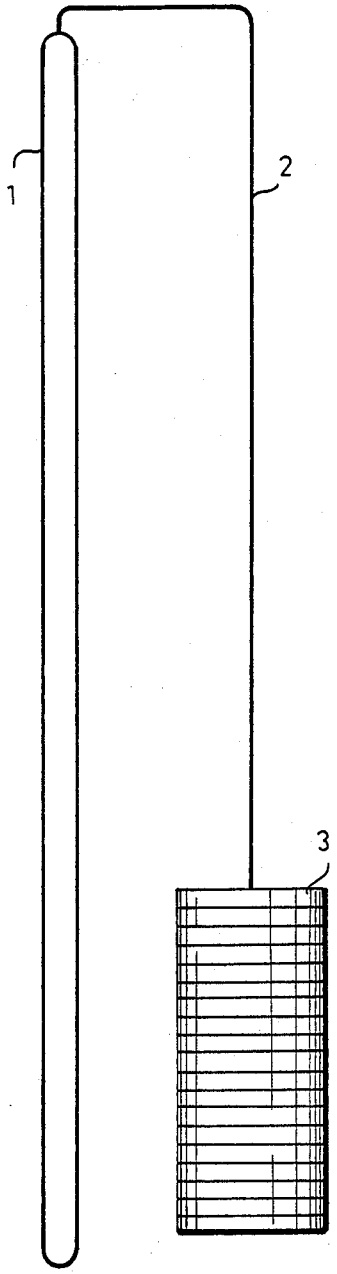
FIG. 1 illustrates a transmission means according to the invention.
Figure 2:
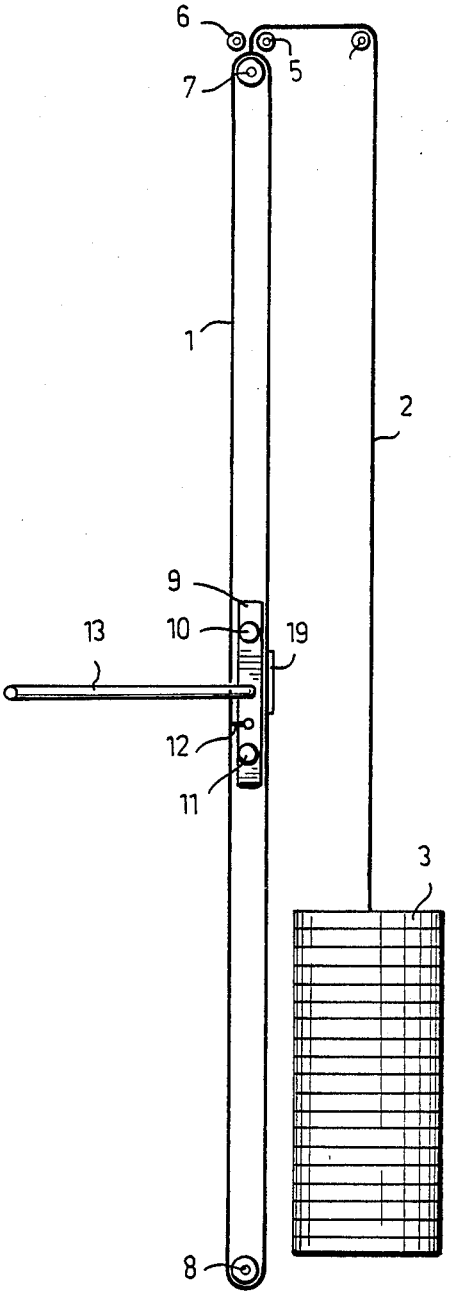
FIG. 2 illustrates the transmission means provided with guide wheels, a carriage and a handle.
Figure 3:
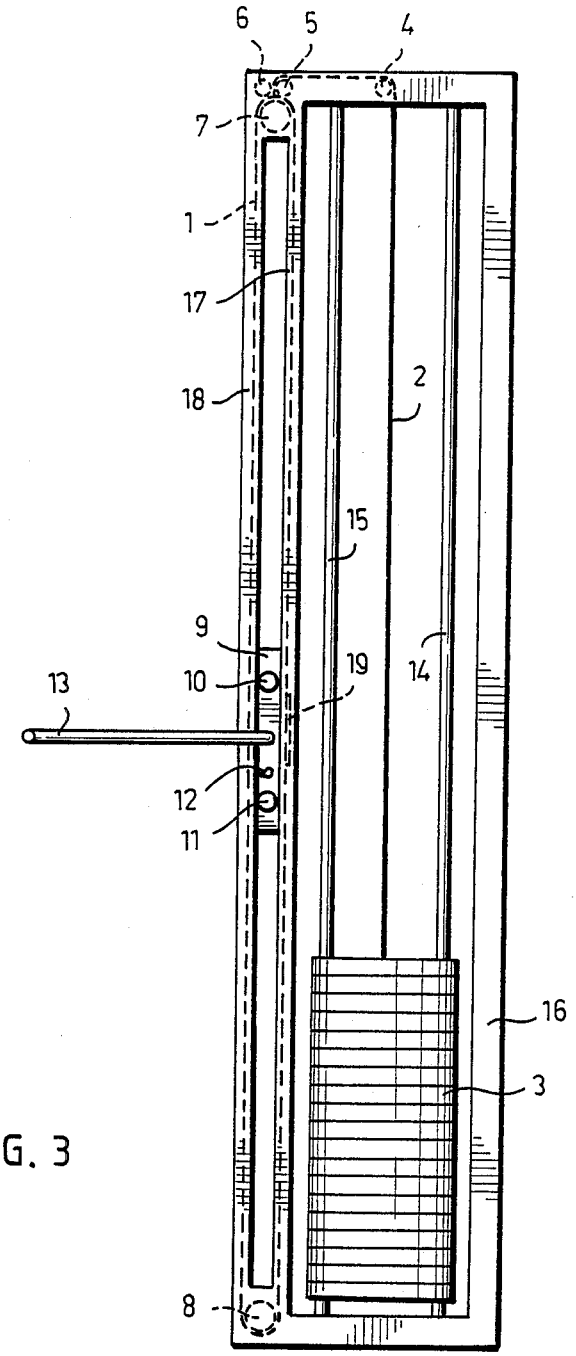
FIG. 3 illustrates the invention as positioned in a known frame.

The device according to the invention comprises a chain, wire, belt or similar transmission means which forms an endless ring 1. A chain, wire, belt or the like 2 at one end is attached to the ring, and at the other end thereof is connected to a selected weight load 3. The ring 1 is passed around wheels 7 and 8. The passage of the transmission means 2, which is connected to the weight load 3, is guided by means of wheels 4, 5 and 6. A carriage 9 is fastened to the ring by means of locking means 12, and the carriage is provided with a gripping, pulling or pushing handle 13. The carriage 9 can be fastened at a desired point on the ring 1 by means of the locking means 12. The carriage 9 is provided with guide wheels, slide surface pegs or the like 10, 11 by means of which the carriage can be guided in a space formed within a frame structure 16. When the carriage 9 is displaced by means of the handle 13 in different directions, the ring 1 pulls the transmission means 2 on either side of the wheel 7, so that the handle 13 is always exposed to the selected weight load 3. By means of the device, a load can be provided in both directions of the movement. The device according to the invention can be fitted in different kinds of frame structures, an example of which is shown in FIG. 3. The frame structure 16 comprises guide bars 14 and 15 for guiding the movement of the weight load 3. The frame structure further comprises two parallel pillars 17 and 18 which define therebetween a space wherein guides 10 and 11 of the carriage 9 can be fitted. The pillars 17 and 18 can also act as covers for the ring 1. A counter weight 19 can be locked at a desired point of the ring 1 in a suitable manner for compensating the weight of the carriage 9.

It is to be noted that the device according to the invention can be positioned e.g. horizontally or at any angle position. Further, several devices according to the invention can be connected to one and the same weight load in parallel, in a sequence or in many other combinations. The transmission means 1 according to the invention can be modified by using more than two wheels. The wheels 7 and 8 can be eccentrical or differ in size, or they can be of some other kind for displacing the transmission means 1 in different directions. The transmission means 2 can be fastened at any point of the transmission means 1.

Furthermore, the carriage 9 does not necessarily need to be displaceable between the guide pillars 17 and 18, but the movement of the carriage can be effected by means of many other solutions. In addition to C-profile, the guide pillars 17 and 18 can be made of raw materials of various shapes. The pillars 17 and 18 guiding the movement of the carriage 9 do not need to be straight; instead, they can be arched or of some other shape. A lever arm, the movement of which can be resisted in both directions, can be connected to the wheels 7 or 8.

What is claimed is:

1. An exercise device comprising a carriage having gripping means for engagement by a user, an endless ring being movable for bidirectional circulation in opposite directions around at least two wheels and comprising first flexible tension transmitting means, locking means for locking said carriage at a desired point on said endless ring, second flexible tension transmitting means having first and second ends and connected at said first end to said first tension transmitting means, and a weight load attached to said second end of said second tension transmitting means whereby said weight load is lifted in response to movement of said gripping means in either of said opposite directions.

2. The exercise device according to claim 1, further comprising a frame structure for guiding the movement of said carriage.

3. The exercise device according to claim 2, wherein said carriage further comprises guide means and said frame structure comprises two guide pillars forming a guide space for receiving said guide means of said carriage and providing a cover for said endless ring.

4. The exercise device according to claim 1, wherein said endless ring comprises a weight fastened at a desired point thereof for compensating the weight of said carriage.

5. The exercise device according to claim 1, wherein said first tension transmitting means is a belt.

6. The exercise device according to claim 1, wherein said first tension transmitting means is a wire.

7. The exercise device according to claim 1, wherein said first tension transmitting means is a chain.

8. The exercise device according to claim 3, wherein said guide means comprises wheels.

9. The exercise device according to claim 3, wherein said guide means comprises slide surfaces.

10. The exercise device according to claim 3, wherein said guide means comprises pegs.

* * * * *